US007866107B2

(12) United States Patent
Conradi

(10) Patent No.: US 7,866,107 B2
(45) Date of Patent: Jan. 11, 2011

(54) CLADDING ELEMENT FOR CONSTRUCTING BUILDING FACADES

(75) Inventor: Ulrich Conradi, Heikendorf (DE)

(73) Assignee: Laukien GmbH & Co. Beteiligungen KG, Kiel (DE)

( * ) Notice: Subject to any disclaimer, the term of this patent is extended or adjusted under 35 U.S.C. 154(b) by 51 days.

(21) Appl. No.: 11/315,289

(22) Filed: Dec. 23, 2005

(65) Prior Publication Data

US 2006/0150558 A1 Jul. 13, 2006

(30) Foreign Application Priority Data

Dec. 23, 2004 (EP) ..... 04030577

(51) Int. Cl.
*E04C 2/38* (2006.01)
*E04B 2/00* (2006.01)

(52) U.S. Cl. ..... 52/473; 52/592.1; 52/588.1; 52/553

(58) Field of Classification Search ..... 52/78, 52/473, 507, 57, 506.09, 581, 592.1, 588.1, 52/177, 553, 521, 518, 519, 545, 546; 454/260, 454/275–282

See application file for complete search history.

(56) References Cited

U.S. PATENT DOCUMENTS

| | | | | | |
|---|---|---|---|---|---|
| 2,587,898 | A * | 3/1952 | Reid | 52/473 |
| 2,602,972 | A * | 7/1952 | Chalfant | 49/86.1 |
| 3,368,315 | A * | 2/1968 | Thurnau | 52/588.1 |
| 4,217,742 | A * | 8/1980 | Evans | 52/553 |
| 4,266,381 | A * | 5/1981 | Deller | 52/177 |
| 4,631,891 | A * | 12/1986 | Donavich | 52/588.1 |
| 4,907,767 | A * | 3/1990 | Corsi et al. | 248/49 |
| 5,134,250 | A * | 7/1992 | Caveney et al. | 174/101 |
| 5,170,605 | A * | 12/1992 | Huddle | 52/588.1 |
| 5,647,184 | A * | 7/1997 | Davis | 52/592.1 |
| 5,816,010 | A | 10/1998 | Conn et al. | |
| 5,819,491 | A * | 10/1998 | Davis | 52/592.1 |
| 5,907,929 | A * | 6/1999 | Poma et al. | 52/78 |
| 6,199,340 | B1 * | 3/2001 | Davis | 52/592.1 |
| 6,226,950 | B1 * | 5/2001 | Davis | 52/592.1 |
| 6,349,507 | B1 * | 2/2002 | Muellerleile | 52/36.5 |
| 6,676,507 | B1 * | 1/2004 | Darcey | 454/260 |
| 7,571,571 | B1 * | 8/2009 | Mershon | 52/36.5 |
| 2006/0150558 | A1 | 7/2006 | Conradi | |
| 2009/0019807 | A1 * | 1/2009 | Conradi | 52/588.1 |

FOREIGN PATENT DOCUMENTS

| | | |
|---|---|---|
| CA | 2 549 843 | 6/2006 |
| DE | 32 39 332 A1 | 5/1984 |
| DE | 42 22 999 | 1/1994 |
| DE | 42 22 999 A1 | 1/1994 |
| DE | 200 16 964 U1 | 4/2001 |
| EP | 0403577.3 | 12/2004 |
| FR | 2 770 244 A | 4/1999 |
| IN | 1867/KOL NP/06 | 7/2006 |
| WO | PCT/DE2005/001994 | 11/2005 |

* cited by examiner

*Primary Examiner*—Robert J Canfield
(74) *Attorney, Agent, or Firm*—Bacon & Thomas, PLLC

(57) ABSTRACT

A cladding element for constructing a facade of a building includes a substantially platelike element provided with a plurality of angular protrusions of essentially angular cross section which protrude from a front side of the platelike element.

16 Claims, 3 Drawing Sheets

Detail A

Detail B

Detail C

Detail D

CLADDING ELEMENT FOR CONSTRUCTING BUILDING FACADES

BACKGROUND OF THE INVENTION

A. Field

The invention relates to a cladding element for constructing building facades.

B. Related Art

In the prior art, many different modes of construction are known for making building facades. In some conventional constructions, for instance, a facade of a building is constructed or formed of the masonry itself, closing the building on the outside by a masonry facade element, or facade elements adhered to the masonry, or by a plaster layer, or by concrete constructions, or by concealing means, such as glass, metal, or other suitable materials. The aforementioned constructions, which belong to the field of conventional facades and which are naturally not exhaustively listed above, are understood here to be merely examples, and are typically fitted directly to the building to be built; that is, they are either set up directly on site where the building is constructed or are prefabricated elsewhere and set up and fitted directly to the building to suit structural requirements.

All these facades, however, depending on the type of the embodiment, have the disadvantage in that they are typically not suited to rapidly building a facade of a building, especially in the industrial field, such as for making facades of factory and warehouse buildings.

To be able to overcome this problem, so-called lamination or panel facades have been developed, which comprise separate individual panel modules, which are secured individually to previously built frame constructions that are applied to an external masonry or other kind of outer wall of a building. These individual panel modules having predetermined lengths and predetermined widths can intrinsically at least partly solve the problems of the known, aforementioned conventional facade cladding solutions, since to a certain extent, with regard to geometric sizes, they can be manufactured and furnished as mass-produced products, and individually adapting these individual modules at the site of the building construction currently requires relatively less effort than the above conventional constructions.

However, the disadvantage of these known individual panels is that an outer surface provided or lined with them still in principle remains open-faced in its entirety, since even when mounted on an outer surface, for example, the individual panels always remain individual panels, regardless of the size of the facade to be clad with them. Another disadvantage of these known individual panels is that each individual panel has to be mounted separately, and the speed at which the outer surfaces of buildings is lined or clad is therefore relatively slow; that is, a great deal of time is needed because each individual panel has to be taken up in the hand, and each one also must be separately mounted individually. Furthermore, facades embodied in this way are typically not tight from all external angles of visual observation, so that often at certain angles of observation, the mounting elements, support elements and other elements, such as ducts and pipes, remain visible behind a facade made up of individual panels.

It is accordingly the object of the present invention to create a cladding element with which fast, tight and dimensionally stable cladding of facades of buildings is possible, which in the process forms a completely closed facade face without using separate connecting elements. Another object of the present invention is to make it possible to erect a facade that is free of separate wall subconstructions such as are necessary in securing individual panels, and further wherein the cladding element is prefabricatable in such a way that, in principle, only in an individual case does it have to be cut to building-specific lengths that may be required by the structural specifications of the building to be clad. The cladding element also should be capable of being manufactured simply and economically.

SUMMARY OF THE INVENTION

These objectives are attained by the invention in that a substantially platelike element, on which a plurality of frontal protrusions of substantially angular cross section are disposed, which protrude from a first or front side of the platelike element, is provided.

Unlike the former individual panel elements, according to the invention platelike cladding elements can in fact be furnished which can finally have an arbitrary suitable length and an arbitrary suitable width, and which moreover, to create different visual appearances, can have an arbitrarily suitable number of the aforementioned angular frontal protrusions that protrude from the front of the platelike element. If desired, the cladding element of the invention can be considered as a facade face that comprises an arbitrary number of integrally joined-together individual panels.

The substantial advantage of the invention essentially is that mounting such cladding elements of the invention can be done very quickly, since a large facade area can be covered with one element, depending on its prefabricated size. Since in fact there are no holes or openings of the kind that occur conventionally in facades built with individual panels, a facade constructed in this way is in principle visually tight, and does not permit any passage through it of moisture, dust and media that act from outside on a facade clad according to the invention.

To enable joining together a plurality of the cladding elements quickly and securely and essentially without tools and extraneous agents, the platelike element, on substantially diametrically opposite sides, such as at the top and bottom in the case of vertical mounting of the cladding element on an outer wall or on a subconstruction, has connection devices, by way of which respectively adjacent cladding elements are connectable.

Various connection devices on the cladding element are conceivable for attaining the goal of as tight a connection as possible with an adjacent cladding element. It has proved very advantageous to choose a construction for the connection device in which the one connection device is embodied in the form of a protrusion of strutlike cross section, and the other connection device is embodied in the form of a receiving part of U-shaped cross section. Thus the strutlike protrusion of the one cladding element can simply be inserted detachably into the U-shaped receiving part of the adjacent cladding element for making the connection. The advantage of such a configuration is that for purposes of repair, maintenance and replacement, the cladding elements can be detached easily from one another, namely in that the strutlike protrusion of the one cladding element can easily be pulled back out of the U-shaped receiving part of the cladding element adjacent to it.

The structural features of the strutlike protrusion and of the corresponding U-shaped receiving part can be selected such that not only a substantially positive-engagement connection of two adjacent cladding elements but also a known positive connection of two adjacent cladding elements is possible; that is, the connections are each such that no separate auxiliary constructions using mechanical means, such as screws, bolts, or adhesive means, are required. The selected construction according to the invention is capable of creating a facade cladding that is essentially free of supporting and auxiliary devices.

In a further feature of the connecting element, the strutlike protrusion of the one connection device has a thickened or offset portion on its free end, while conversely and advantageously, the U-shaped receiving part of the other connection device has a thickened portion on the free end of a free leg. It is thus advantageously possible, with extremely simple means, to create an even more-secure and simpler connection of two adjacent cladding elements because of these advantageous constructions of the cladding element, since in the connected state of two cladding elements the thickened or offset portion of the strutlike protrusion of the one connecting element engages in detent-locking fashion between the thickened portion of the one leg of the U-shaped receiving part. The thickened portions are each dimensioned such that whenever the thickened or offset end of the strutlike protrusion is introduced into the U-shaped receiving part, a slight elastic deformation of the two legs of the U-shaped receiving part occurs, until the thickened or offset portion on the strutlike protrusion of the one connection device has slid past the thickened portion on the one leg of the U-shaped receiving part of the other connection device, and the two elastically deformed legs of the U-shaped receiving part return to their undeformed original position.

The cladding element can preferably be further refined such that the platelike element has a plurality of rear offset protrusions, which protrude from a second or rear side of the platelike element. These offset protrusions, provided virtually on the rear side of the platelike element, can on the one hand serve to increase the connection stability of the cladding element, so that the platelike element can nevertheless be embodied as very lightweight, and on the other hand, the protrusions themselves are also a simple means for enabling the cladding element to be braced on its rear side against the framework, masonry, or load-bearing construction of a building to be clad. Optionally the offset protrusions also be used as additional fastening means.

In principle, the rear offset protrusions can be located at arbitrary suitable points on the second or rear side of the platelike element; the number and the choice of the offset protrusions can be selected as a function of the intended use of the cladding element in the context of the construction or manufacture of the cladding element. It is advantageous, since it is structurally simple to embody and since it creates high intrinsic stability of the cladding element in a simple way, to locate the offset protrusions substantially diametrically opposite the angular protrusions on the first or front side of the platelike element. Thus nodes in the cross section material of the cladding element increase the stability of the cladding element.

The front angular protrusions can in principle have arbitrary suitable angles relative to the angling of the legs of the angular protrusions connecting the angular protrusions to the platelike elements, and these angles can in principle even be of different sizes for one cladding element and different angular protrusions located thereon. However, it is advantageous to form the cladding element such that the connecting legs of the angular protrusions form an angle that is greater than 90°; it is especially advantageous to select the angle such that it is essentially in a range of from 110° to 130°. By means of these angles listed, it will always be assured that rainwater striking the cladding element, when the cladding element is mounted essentially vertically, can always drain off safely to the outside, or in other words outwardly away from the cladding element.

The connecting leg of the angular protrusion, which leg is connected to the platelike element and forms an angle with it, can also be adapted in an arbitrarily suitable way to the platelike element in terms of its angle of attachment, and this angle is also a parameter that can be taken into account in the engineering design of the cladding element; that is, it can already be selected in the course of manufacture to suit the later use of the cladding element.

In this respect again, however, it is advantageous to design the cladding element such that the connecting leg of the angular protrusion forms an angle with the platelike element that is less than 90°, and in this case as well it is highly advantageous to select the angle essentially within a range of from 70° to 50°.

In still another advantageous embodiment of the cladding element, the region of the platelike element where the associated leg of the angular protrusion intersects the platelike element has a thinned cross section compared to the remaining adjacent cross-sectional thickness of the platelike element; as a result, in a simple way, a water deflecting and drain edge for water striking the first side of the platelike element is created when the cladding element is for instance mounted essentially vertically.

Since the cladding element of the invention is a mass-produced product, in other words is meant to be capable of being manufactured simply and inexpensively in large quantities, it is advantageous to embody it as an extruded profile, for instance; by means of the familiar technique of extrusion, even complicated cross-sectional shapes, as for instance for the cladding element of the invention, can be produced quickly and economically and have high intrinsic stability.

As the material for embodying the cladding element, arbitrary suitable metal materials are possible, such as preferably aluminum or an aluminum alloy. Aluminum in particular, because the cross-sectional shape of the cladding element according to the invention has the advantage that, on the one hand, it can be highly stable, and on the other can be very light in weight.

However, it is preferably also possible, to select as the material for the cladding element a plastic material, such as fiber- and/or metal-cloth-reinforced material. In this case as well, for producing the cladding elements, the known extruded profile techniques can be employed; that is, the advantages of this production or manufacturing technique can also be exploited.

BRIEF DESCRIPTION OF THE DRAWINGS

The invention will now be described in detail in conjunction with the accompanying drawings, in terms of an exemplary embodiment. In the drawings.

DETAILED DESCRIPTION OF PREFERRED EMBODIMENTS OF THE INVENTION

Figure 1:
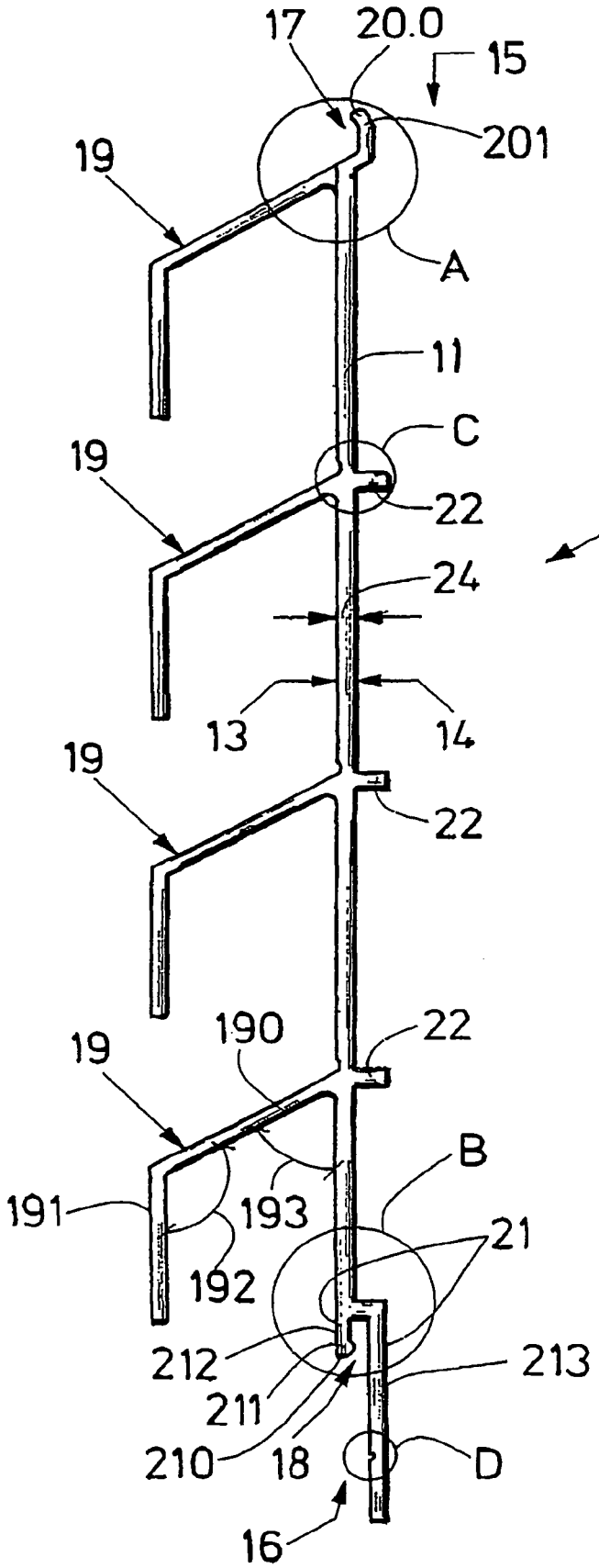
FIG. 1, in cross section, shows a cladding element of the invention on a scale of approximately 1:1.

First, reference will be made to FIG. 1, in which the basic makeup of a cladding element 10 of the invention is shown in cross section. The cladding element 10 shown in FIG. 1 is shown on a scale of approximately 1:1; that is, a possible embodiment of the cladding element in terms of its height and width is equivalent to what is actually shown in FIG. 1. The length of the cladding element, that is, looking into the sheet or out of the sheet in terms of the viewing direction in FIG. 1, can be selected arbitrarily, and lengths of one to several meters are possible for the cladding element 10.

The basic element of the cladding element 10 is a platelike element 11. On the first or front side 13 of platelike element 11, four angular protrusions 19 having an angular cross section are located, spaced apart substantially equally from one another. The angular protrusions 19, when the cladding element 10 is applied to a building (not shown), point outward and to the front, or in other words to the left in terms of FIG. 1. It should be noted that depending on the size of the cladding element 10 and on the size of the selected angular protrusions 19, fewer or more than four angular protrusions 19 may be provided on the platelike element 11.

The angle 192 between the two legs 190, 191 of the angular protrusion 19 is 120°, in the cladding element 10 shown. The angle 193 between the platelike element 11 and the adjoining connecting leg 190 of the angular protrusion 19 is 60° here. It should be pointed out that naturally still other angles are possible, depending on specifications and the location where the cladding element 10 is used.

On the platelike element 11, on diametrically opposed ends 15, 16, in other words at the top and bottom in terms of the viewing direction in FIG. 1, connection devices 17, 18 are provided. The upper connection device in FIG. 1 is embodied as a strutlike protrusion 20 having a strutlike cross section. The bottom connection device 18 in the drawing is embodied in the form of a receiving part 21 of U-shaped cross section. The upper strutlike protrusion 20 is embodied as offset to the right, in terms of FIG. 1, in relation to the area formed by the second or rear side 14 of the platelike element 11, the offset corresponding approximately to the cross-sectional thickness 24 of the platelike element 11. On the free end 200 of the strutlike protrusion, a thickened or offset portion 201 is provided, that is, a thickened portion compared to the cross-sectional thickness of the strutlike protrusion 20; its significance will be explained hereinafter.

Figure 2:
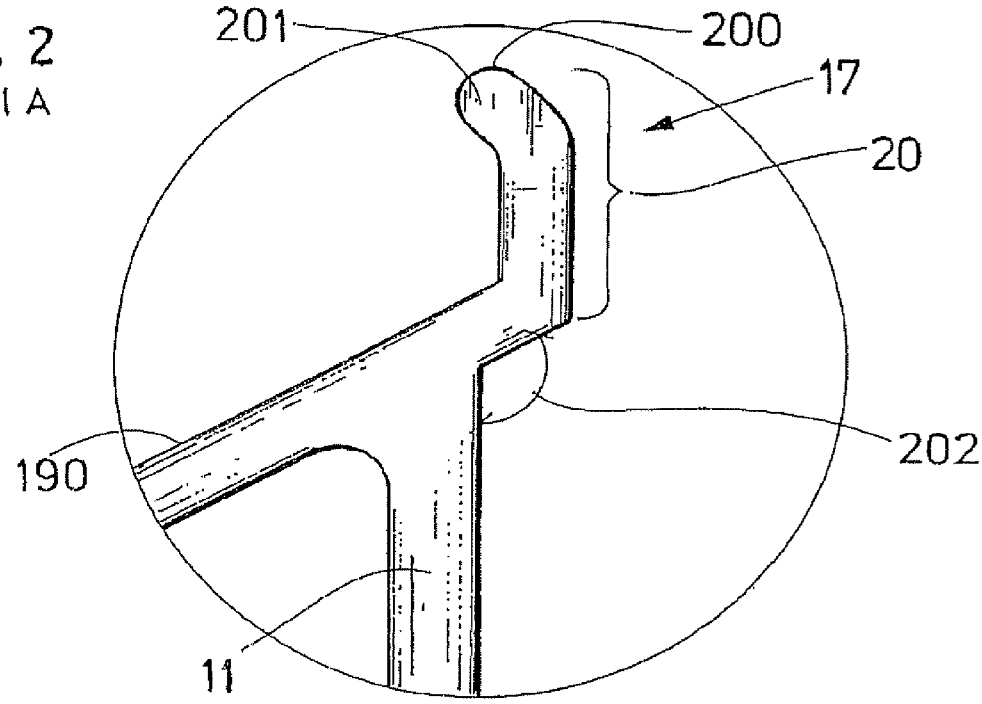
FIG. 2, in cross section, shows an enlarged view of the detail A of FIG. 1.

The one leg 212 of the U-shaped receiving part 21, on the lower side 16 in terms of FIG. 2 of the cladding element 10, likewise has a thickened or offset portion 211 on the free end 210 of the leg 212. The second leg 213 of the U-shaped receiving part 21 is embodied as very much longer than the first leg 212; the significance of this characteristic will also be described hereinafter in conjunction with the upper strutlike protrusion.

Figure 4:
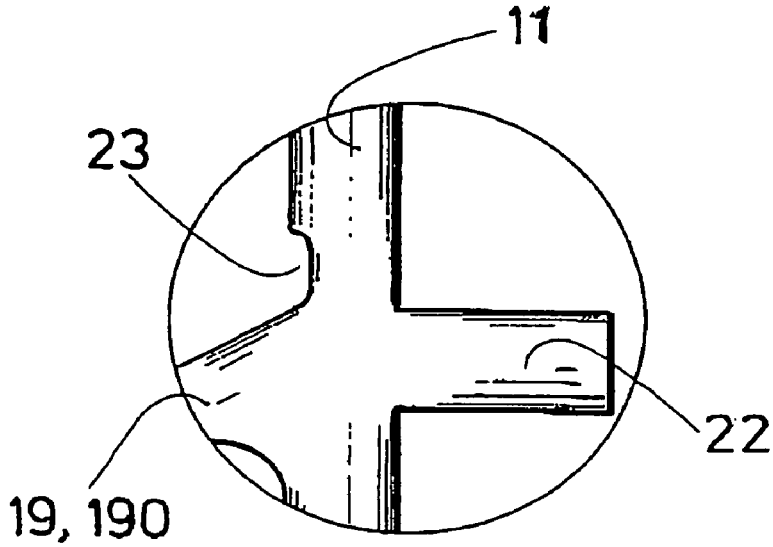
FIG. 4, in cross section, shows the detail C of FIG. 1 on a larger scale.
Figure 5:
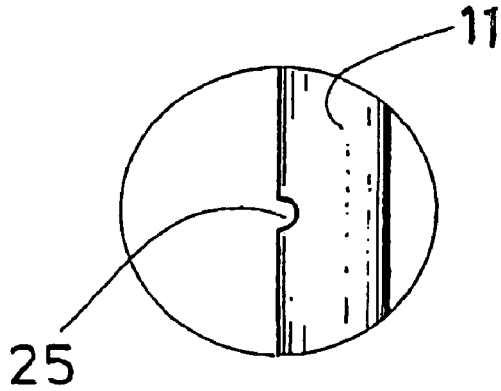
FIG. 5, in cross section, shows the detail D of FIG. 1 on a larger scale.

On the aforementioned second or rear side 14 of the platelike element, a plurality of offset protrusions 22 are provided. These offset protrusions protrude substantially at a right angle from the platelike element 11. In the embodiment of the cladding element 10 shown in the drawings, the protrusions 22 are located such that they are diametrically opposite the fastening regions of the angular protrusions 19 on the platelike element 10. In the region where the angular protrusions adjoin the platelike element 11, a region 23 of the platelike element 11 is provided in which the cross-sectional thickness 24 is thinner than the cross-sectional thickness of the remaining adjacent regions of the platelike element 10; see also the detail C in FIG. 4.

Figure 3:
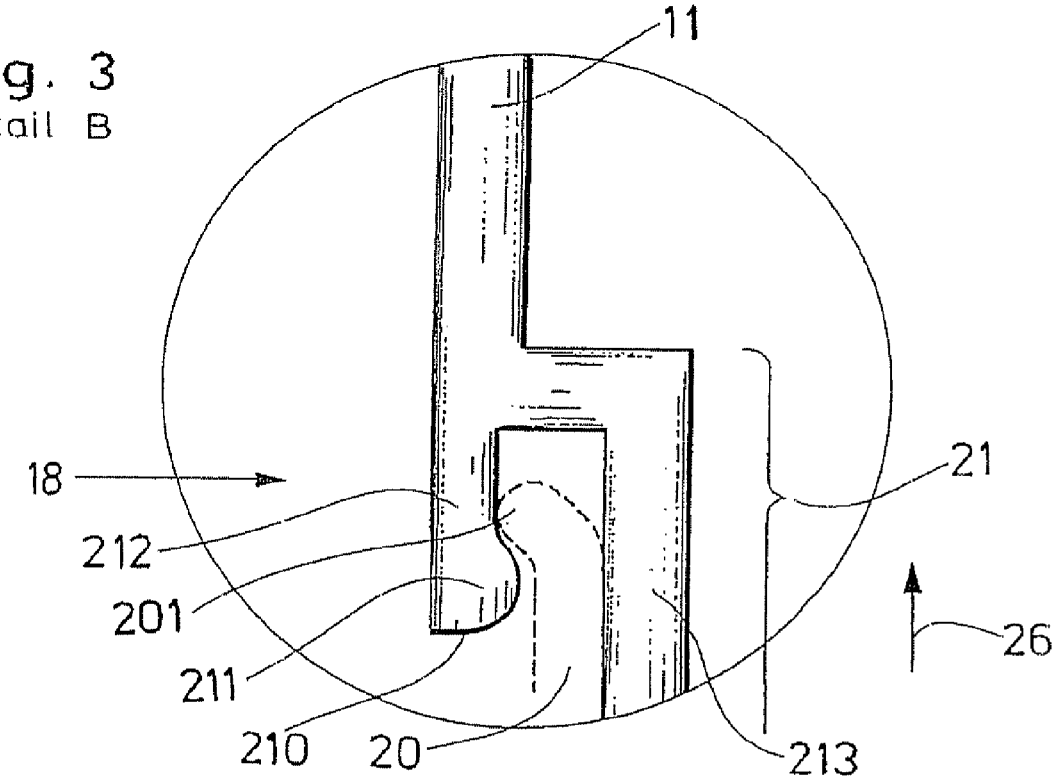
FIG. 3, in cross section, shows the detail B of FIG. 1 on a larger scale.

FIG. 2, which shows the detail A of FIG. 1, and FIG. 3, which shows the detail B of FIG. 1, will now be described. FIG. 3 shows a formed connection, or a connected state, between two cladding elements 10; in FIG. 3, the "upper" cladding element is shown in solid lines, while the lower cladding element 10, of which only the strutlike protrusion 20 is shown, is shown in dashed lines.

The height and thickness of the thickened portion 201 of the strutlike protrusion 20 of the lower platelike element 11 and the thickness and height of the thickened portion 211 of the one leg 212 of the U-shaped receiving part 21 of the upper platelike element 11 are dimensioned such that when the strutlike protrusion 20 is inserted between the legs 212, 213 of the U-shaped receiving part 21 of the upper platelike element 11, a slight elastic deformation occurs, that is, a spreading apart of the two legs 212, 213, so that the strutlike protrusion 20, or its thickened portion 201, of the lower platelike element 11 can slide behind the thickened portion 211, or in other words farther into the U-shaped receiving part 21, so that as a consequence of this motion, the two angles 212, 213 return to their original position, and both thickened portions 201, 211 form an interlocked final connection. In this position, as it is shown in FIG. 3, both cladding elements 10 are joined together by nonpositive engagement. By means of an opposite force of suitable magnitude, exerted counter to the direction of the arrow 26, both platelike elements can be disconnected from one another again, with elastic deformation of the two legs 212, 213 of the U-shaped receiving part 21. Thus the connection between two adjacent cladding elements 10 is a nonpositive connection, which can, however, also be undone again.

As already indicated above, the strutlike protrusion 20 is offset, toward the right in terms of FIGS. 1 and 2, from the area covered by the second side 14 of the platelike element 11. The magnitude of the offset is dimensioned such that in the joined-together state of two platelike elements 11—see FIG. 3—the covered areas on the ends 15 and 16 of the adjacent platelike elements 11 are located in the same planes. As a result, an absolutely flat installation of an arbitrary number of platelike elements 11 is possible.

The second leg 213 of the U-shaped receiving part 21 serves to guide and contact the strutlike protrusion 20; see also FIG. 3; that is, in the mounting of two adjacent platelike elements, the strutlike protrusion 20 needs to be placed only against the inner side of the leg 213 of the adjacent platelike element 11 and to be thrust in the direction of the arrow 26 into a mutually interlocked position.

On the second leg 213, on the side of the platelike element 11 oriented toward the side 16, a groove 25 is provided, which has the function of a water drainage edge.

If for certain purposes installations are to be made in the cladding element 10, openings (not shown) may be provided in the platelike element 11; this can be done on site in the course of mounting the cladding elements 10, and moreover is equally possible for instance for creating vent and/or ventilation openings.

The invention claimed is:

1. A cladding element for constructing building facades, comprising a substantially platelike element having a front side from which a plurality of angular protrusions of substantially angular cross section extend, wherein the platelike element has on substantially diametrically opposite ends connection devices configured and arranged for connection to respective adjacent cladding elements, one of said connection devices is in the form of a strutlike protrusion of strutlike cross section, and the other of said connection devices is in the form of a receiving part of U-shaped cross section having a first leg and a second leg defining an opening therebetween;

wherein the strutlike protrusion has a thickened or offset portion on a free end portion thereof, and the U-shaped receiving part of the other connection device has a thickened portion on a free end portion of a first leg thereof;

wherein the opening of the U-shaped receiving part has a width slightly less than a thickness of the thickened or offset portion of the strutlike protrusion, and at least one of the first and second legs is resiliently elastically deformable such that the deformable leg is movable to a deformed position to allow insertion of the thickened or offset portion of the strutlike protrusion, the deformable leg returning to its undeformed position upon full insertion of the strutlike protrusion;

wherein in a connected state of two adjacent cladding elements, the thickened or offset portion of the strutlike protrusion of one connecting element engages in detent-locking fashion with the thickened portion of the first leg of the U-shaped receiving part; and wherein the platelike element has a plurality of offset rear protrusions which protrude from the rear side of the platelike element.

2. The cladding element of claim 1, wherein the strutlike protrusion is insertable detachably into the U-shaped receiving part of an adjacent cladding element for making a connection between the cladding elements.

3. The cladding element of claim 2, wherein the connection of the adjacent cladding elements to one another is carried out by at least a nonpositive engagement.

4. The cladding element of claim 1, wherein the offset rear protrusions are located substantially diametrically opposite the angular protrusions on the front side of the platelike element.

5. The cladding element of claim 1, wherein the angular protrusions include connector legs that form an angle that is greater than 90° relative to the remaining part of the angular protrusions.

6. The cladding element of claim 5, wherein the angle is substantially in a range of from 110° to 130°.

7. The cladding element of claim 1, wherein the angular protrusions include connector legs adjoining the platelike element that extend at an angle relative to the platelike element that is less than 90°.

8. The cladding element of claim 7, wherein said angle is substantially in a range of from 70° to 50°.

9. The cladding element of claim 7, wherein the region of the platelike element which is intersected by a connector leg, associated with an angular protrusion has a thinner cross-section compared to the adjacent cross-sectional thickness of the platelike element.

10. The cladding element of claim 1, formed as an extruded profile.

11. The cladding element of claim 1, wherein the material of the platelike element is a metal.

12. The cladding element of claim 1, wherein the material of the cladding element is a plastic material.

13. The cladding element of claim 1, wherein said rear protrusions protrude from a rear surface of the platelike element.

14. The cladding element of claim 1, wherein said rear protrusions are arranged to space said platelike element apart from a surface or structure against which the cladding element is mounted.

15. The cladding element of claim 1, wherein said rear protrusions are arranged corresponding to, and opposite, fastening regions of said angular protrusions on said platelike element.

16. A cladding element for constructing building facades, comprising a substantially platelike element having a front side from which a plurality of angular protrusions of substantially angular cross section extend, wherein the platelike element has on substantially diametrically opposite ends connection devices configured and arranged for connection to respective adjacent cladding elements, one of said connection devices is in the form of a strutlike protrusion of strutlike cross section, and the other of said connection devices is in the form of a receiving part of U-shaped cross section having a first leg and a second leg defining an opening therebetween;

wherein the strutlike protrusion has a thickened or offset portion on a free end portion thereof, and the U-shaped receiving part of the other connection device has a thickened portion on a free end portion of a first leg thereof;

wherein the opening of the U-shaped receiving part has a width slightly less than a thickness of the thickened or offset portion of the strutlike protrusion, and at least one of the first and second legs is resiliently elastically deformable such that the deformable leg is movable to a deformed position to allow insertion of the thickened or offset portion of the strutlike protrusion, the deformable leg returning to its undeformed position upon full insertion of the strutlike protrusion;

wherein in a connected state of two adjacent cladding elements, the thickened or offset portion of the strutlike protrusion of one connecting element engages in detent-locking fashion with the thickened portion of the first leg of the U-shaped receiving part; and wherein the U-shaped receiving part has a second leg located at a rearward position with respect to the first leg and substantially longer than the first leg.

* * * * *